US005842571A

United States Patent [19]

Rausch

[11] Patent Number: 5,842,571

[45] Date of Patent: Dec. 1, 1998

[54] COMPARTMENTALIZED SOFT-SIDED CONTAINER

[75] Inventor: Kevin Rausch, Wooster, Ohio

[73] Assignee: Rubbermaid Incorporated, Wooster, Ohio

[21] Appl. No.: 863,959

[22] Filed: May 27, 1997

[51] Int. Cl.[6] ..... A45C 11/20

[52] U.S. Cl. ..... 206/549; 206/541; 62/457.7

[58] Field of Search ..... 206/541, 545, 206/546, 549, 316.2; 62/457.5, 457.4, 457.7, 457.3; 190/110

[56] References Cited

U.S. PATENT DOCUMENTS

| | | | |
|---|---|---|---|
| D. 389,704 | 1/1998 | Yousko et al. | D7/607 |
| 2,555,788 | 6/1951 | Donaldson | 206/549 |
| 2,645,332 | 7/1953 | Martin et al. | 206/545 |
| 3,255,607 | 6/1966 | Bair et al. | 62/457.7 |
| 3,998,072 | 12/1976 | Shaw | 62/457.4 |
| 4,050,264 | 9/1977 | Tanaka | 62/457.7 |
| 4,610,286 | 9/1986 | Cyr | 206/316.2 |
| 4,673,117 | 6/1987 | Calton | 224/151 |
| 4,706,856 | 11/1987 | Jacober | 224/151 |
| 4,819,793 | 4/1989 | Willard et al. | 62/457.5 |
| 4,858,444 | 8/1989 | Scott | 62/457.5 |
| 4,923,060 | 5/1990 | Breslau | 206/316.2 |
| 4,941,603 | 7/1990 | Creamer et al. | 224/148 |
| 4,984,662 | 1/1991 | Jacober | 190/107 |
| 5,313,807 | 5/1994 | Owen | 62/457.3 |
| 5,400,610 | 3/1995 | Macedo | 62/130 |
| 5,501,338 | 3/1996 | Preston | 206/549 |
| 5,505,307 | 4/1996 | Shink | 206/541 |

*Primary Examiner*—David T. Fidei
*Attorney, Agent, or Firm*—Renner, Kenner, Greive, Bobak, Taylor & Weber

[57] ABSTRACT

A compartmentalized soft-sided container (10) includes a beverage compartment (12) disposed in front of a warm compartment (14) and a cool compartment (16). A pair of removable insulating interior walls (40, 42) are attachable to the interior of the container (10) to divide the container (10) into the individual compartments (12, 14, 16). The beverage compartment (12) includes an adjustable closure (64) that is capable of tightly securing differently-sized beverage containers (62) by providing a flexible sheet having a drawstring (66) that allows the height and opening of the closure (64) to be adjusted. The drawstring (66) may also be used to cinch about the neck of a beverage container (62) to securely hold it in container (10). Container (10) is also tapered such that compartments (14, 16) snugly retain articles such as soup bowls (78, 80) to prevent spilling.

17 Claims, 3 Drawing Sheets

COMPARTMENTALIZED SOFT-SIDED CONTAINER

TECHNICAL FIELD

This invention is related to containers and, in particular, to a compartmentalized soft-sided container. Specifically, the present invention is related to a soft-sided container having separate compartments for beverages, warm items, and cool items.

BACKGROUND ART

Soft-sided containers have become popular in recent times due to their convenience. These containers are particularly convenient because they may be easily stored after use in a relatively small space such as a briefcase or a purse. The containers are also easy to pack because they are flexible and accommodate differently-shaped items.

Few of these containers, however, include a separate compartment for holding a beverage container. As such, the containers often cause cold drinks to be stored directly next to a room temperature or a warm item, causing the warmer item to cool and the cool beverage to be undesirably warmed. Commonly known containers also cause the beverage to be relatively loosely stored in the container and allow it to move about. In addition, some containers do not easily accommodate differently-sized beverage containers such as the commonly sold 12, 16, and 20 oz. beverage containers.

It is also desirable to provide a container with separate chambers for holding hot and cold items. Many containers have only a single chamber to hold all food items and beverage items. Such configurations allow the warm and cool items to be in contact thereby causing undesirable heat exchanges. It is thus desirable to provide a soft-sided compartmentalized container that has individual compartments for holding different items.

Other known containers do not provide any devices to retain a food container placed therein. As such, a food container such as a soup bowl may be easily tipped over. Such tipping increases the possibilities of leaks even when the food container has a lid. Thus, it is desirable to provide a compartment in a soft-sided container that is configured to engage a food container and hold it in an upright state.

DISCLOSURE OF THE INVENTION

In view of the foregoing, it is an object of the present invention to provide a compartmentalized soft-sided container having separate chambers for holding beverages, hot items, and cold items.

It is another object of the present invention to provide a compartmentalized soft-sided container, as above, having an adjustable beverage compartment capable of securing differently-sized beverage containers.

It is a further object of the present invention to provide a compartmentalized soft-sided container, as above, having at least three compartments formed by removable walls such that the container may be configured to have one, two, or three compartments.

It is yet another object of the present invention to provide a compartmentalized soft-sided container, as above, having a chamber that is configured to engage a food container and hold it in an upright position.

It is still another object of the present invention to provide a compartmentalized soft-sided container, as above, having an overall kidney-shaped configuration that allows the container to conform to a person's body when it is carried by a shoulder strap.

These and other objects of the present invention, which will become apparent from the description to follow, are accomplished by the improvements hereinafter described and claimed.

In general, in accordance with one aspect of the present invention, a soft-sided container includes a plurality of walls defining at least one compartment in the container. The compartment is configured to receive a beverage container. A closure adjustably closes the beverage container compartment such that differently-sized beverage containers may be retained in the beverage container compartment by the closure.

In accordance with another aspect of the present invention, the soft-side container may also include a pair of side walls connected by a top wall, a bottom wall, a front wall, and a rear wall to define a tapered compartment. The tapered compartment is configured to engage an article substantially the same size as the narrowest portion of the tapered compartment when the article is placed in the tapered compartment to substantially retain the article.

In yet another aspect of the present invention, the soft-sided container includes a plurality of exterior walls connected to define a single compartment therein. A vertical insulated interior wall is removably attached to at least two of the exterior walls such that the container is divided into two compartments when the vertical insulated interior wall is attached to the exterior walls. A substantially horizontal insulated interior wall is removably attached to at least two of the exterior walls such that when the horizontal insulated interior wall is attached to the exterior walls and the vertical insulated interior wall is attached to the exterior walls, three individually insulated compartments are defined by the walls. The insulated interior walls may be selectively removable to configure the container to have different numbers of compartments.

A preferred compartmentalized soft-sided container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
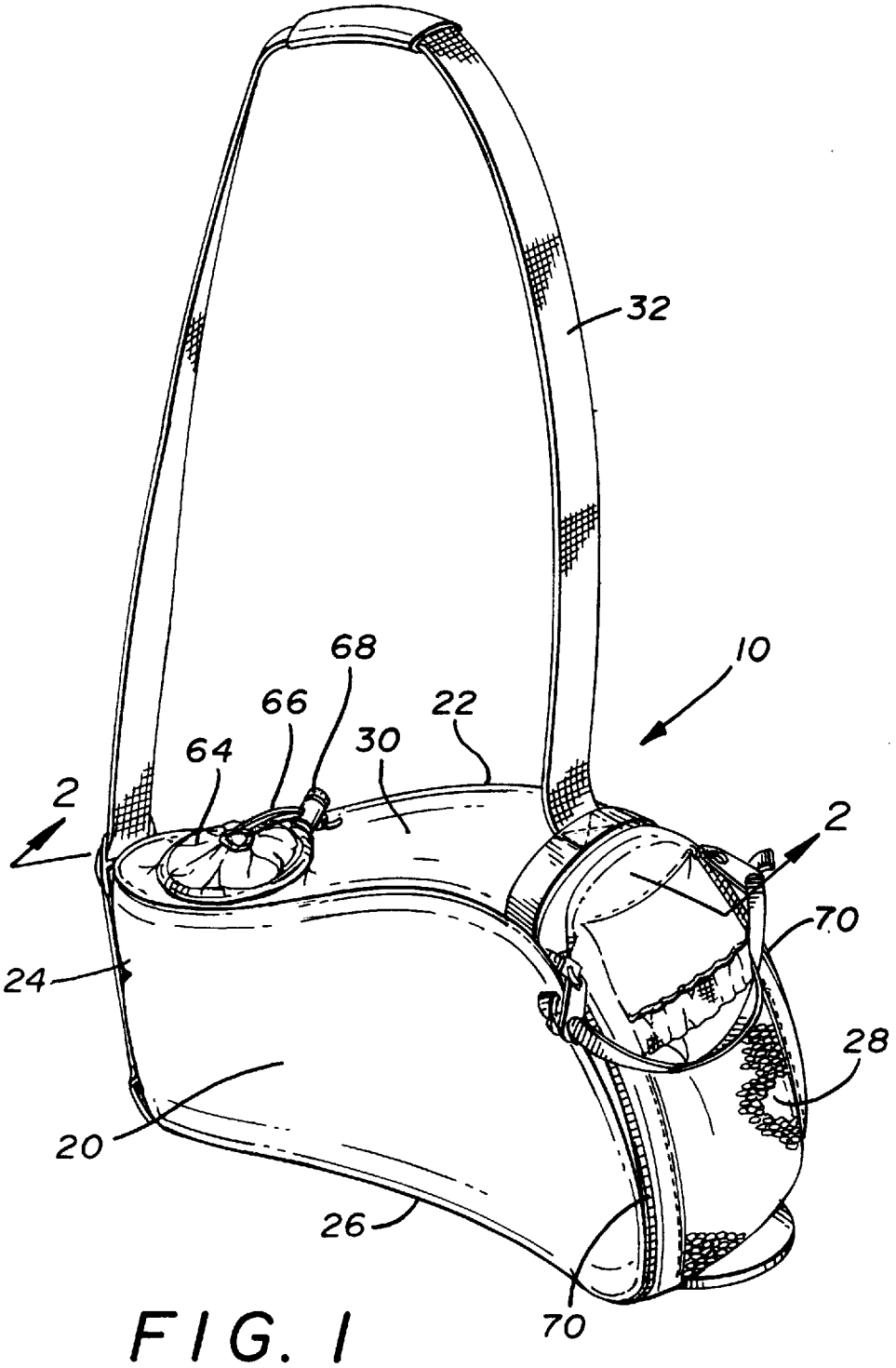
FIG. 1 is a perspective view of a compartmentalized soft-sided container made in accordance with the concepts of the present invention.

A compartmentalized soft-sided container made in accordance with the concepts of the present invention is indicated generally by the numeral 10 in the accompanying drawings. Container 10 generally includes an adjustable beverage compartment 12 disposed in front of two other compartments, one of which, for example, may be a warm compartment 14 and the other of which could be a cool compartment 16. Container 10 has an overall kidney-shaped configuration such that its opposed side walls 20 and 22 are curved. Side walls 20, 22 are connected by a curved front wall 24, a bottom wall 26, a rear wall 28, and a humped top wall 30.

A shoulder carrying strap 32 may be attached to front wall 24 and the upper portion of top wall 30. Carrying strap 32 allows a person to carry container 10 by the shoulder and have curved wall 20 rest comfortably against the person's side.

Container 10 may be compartmentalized by two individually removable interior walls 40, 42. A vertical interior wall 40 substantially divides beverage compartment 12 from both warm 14 and cool 16 compartments. A horizontal interior wall 42, in turn, separates warm compartment 14 from cool compartment 16. Each of interior walls 40, 42 are selectively removable from container 10 such that container 10 may be configured to have one, two, or three compartments.

Interior walls 40, 42 may be removably attached to the interior surfaces of container 10 by any known connectors. However, it has been found that a mechanical hook and loop connector such as that sold under the VELCRO® trademark is particularly useful for removably supporting interior walls 40, 42. As such, a pair of strips 44 of the connector may be attached to the interior of each side wall 20, 22 at the location where horizontal interior wall 42 is to be positioned. Similarly, a pair of strips 46 of the connector are attached to the interior of top wall 30 and bottom wall 26 where vertical interior wall 40 is to be positioned. In turn, each interior wall 40, 42 carries a corresponding strip of the connector configured to substantially match the strips 44, 46 of the connector that are attached to the interior of the container 10. The corresponding strips of the connector are carried by vertical interior wall 40 by a pair of tabs 50 that are flexibly carried by interior wall 40. Similarly, corresponding strips of the connector are carried by flexible tabs 52 that are carried by horizontal interior wall 42. It is also contemplated that a separate connector (not shown) may removably connect horizontal interior wall 42 directly to vertical interior wall 40 to provide additional support to horizontal wall 42 if such support is desired.

In general, all of the walls of container 10 may be fabricated from a material that is relatively easy to clean and is somewhat resistant to liquid. It is also desirable that the walls be also constructed from an insulating material such that the walls of container 10 function to insulate each of compartments 12, 14 and 16 from each other. Such insulation allows adjacent compartments to be used for items having significantly different temperatures. All of the walls may be separately formed and stitched together by methods commonly known in the art or some of the walls may be integrally formed together.

Figure 2:
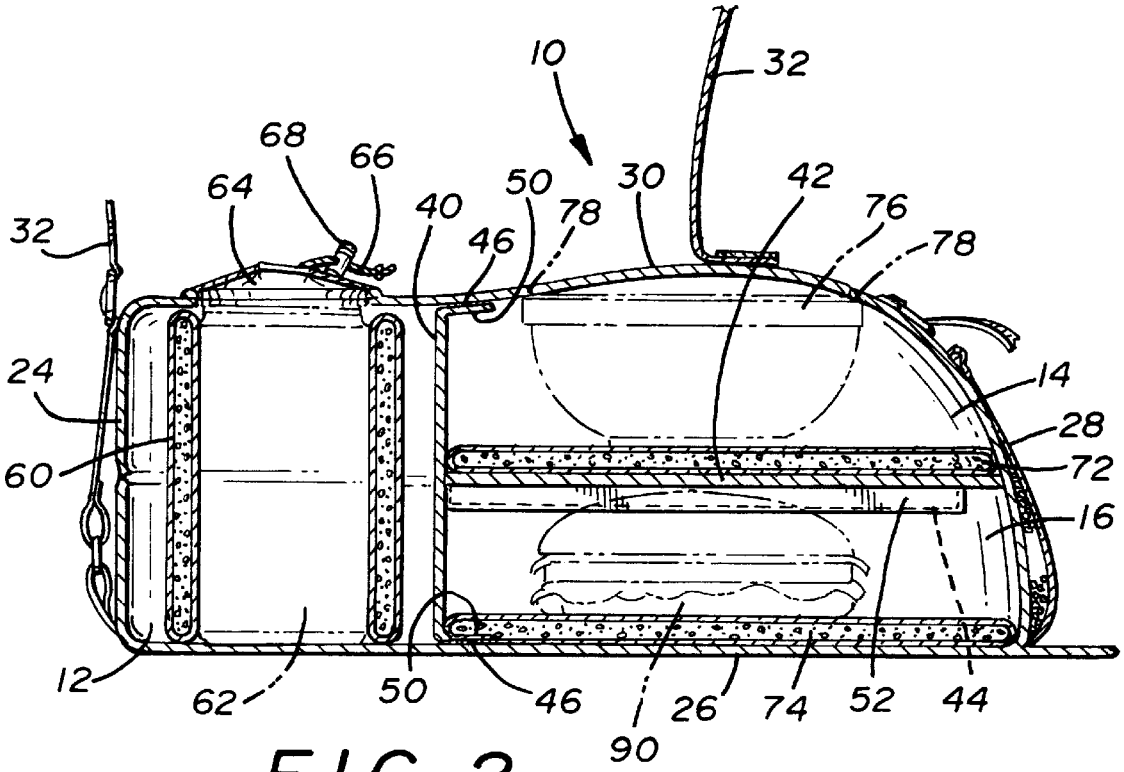
FIG. 2 is a sectional view of the container taken substantially along line 2—2 of FIG. 1.

Beverage compartment 12 is configured to receive a cylindrical chemical coolant pack or ice pack 60 that may be snugly received about the circumference of a beverage container 62 to keep the contents of container 62 cooled. Beverage compartment 12 is selectively closed at its upper end by an adjustable closure 64 that may be fabricated from a relatively flexible material such as flexible nylon. Flexible closure 64 has an opening 66 disposed in its center portion that is selectively opened and closed by a drawstring 66. Drawstring 66 is carried by closure 64 around the circumference of opening 66. When drawstring 66 is drawn up tight, closure 64 is substantially closed and may be substantially flush with top wall 30 of container 10 as shown in FIGS. 1 and 2. This configuration is particularly useful when the beverage container 62 which is being carried in beverage compartment 12 is of a size so as not to extend beyond the boundaries of top wall 30. In the preferred embodiment of the present invention, beverage compartment 12 is configured to receive a typical 12 oz. beverage container 62 within its boundaries as shown in FIG. 2. A spring lock 68 is carried by drawstring 66 and allows the position of drawstring 66 to be locked.

Figure 3:
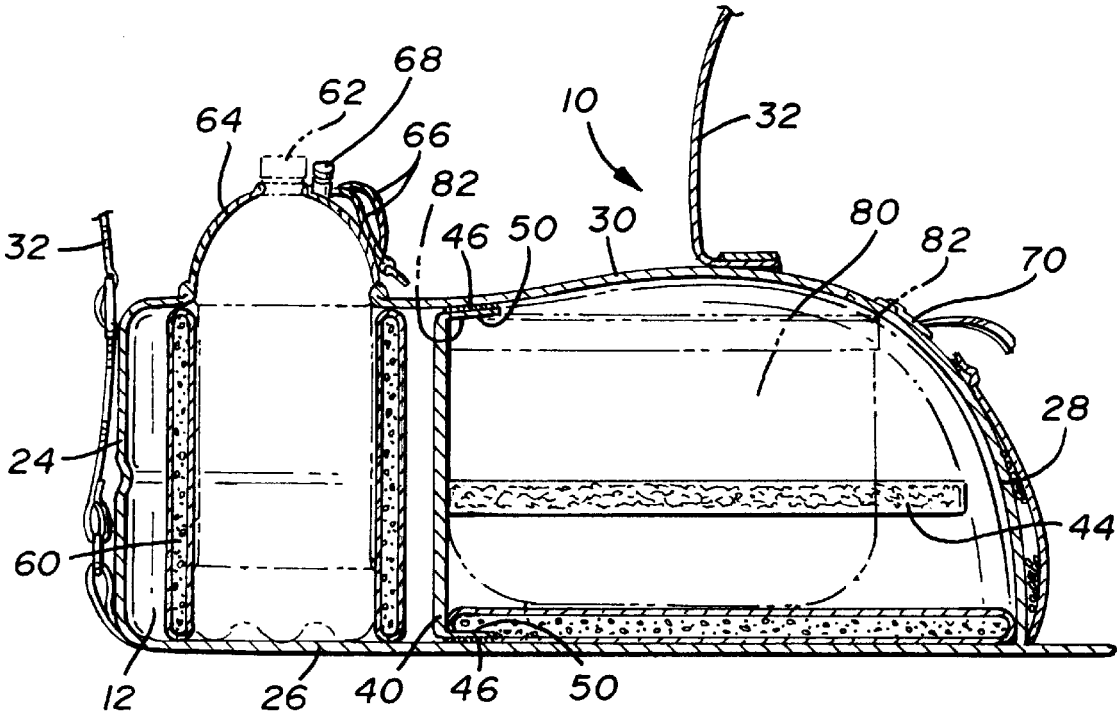
FIG. 3 is a sectional view similar to FIG. 2 showing the beverage compartment in an expanded condition and the container configured to have two compartments.

Beverage compartment 12 may also receive and retain larger beverage containers 62 such as typical 16 oz. or 20 oz. bottles as shown in FIG. 3. When such a container 62 is carried by beverage compartment 12, a portion of container 62 extends above the boundaries of top wall 30 and protrudes from container 10 as depicted in FIG. 3. When this occurs, closure 64 is expanded by releasing spring lock 68 and pulling closure 64 upward. Closure 64 is then snugly positioned about the neck and shoulder portions of beverage container 62 and drawstring 66 is drawn tight to securely retain beverage container 62 in beverage compartment 12. When so received, beverage container 62 may not fall out of container 10 even if container 10 might be turned upside down. The present invention also contemplates that other articles may be stored and carried in beverage compartment 12.

Warm 14 and cool 16 compartments are accessible through rear wall 28 of container 10. To provide access, rear wall 28 is removably attached to side walls 20, 22 of container 10 by a pair of suitable connectors such as the zippers 70 depicted in the drawings. When zippers 70 are opened, rear wall 28 may be opened to provide access to each compartment 14, 16. Each compartment 14, 16 is configured to selectively receive a chemical warming pack 72 or chemical cooling pack or ice pack 74 as well as a standard-sized food container commonly used to store food items. It is also contemplated that a food item such as a sandwich 90 may be placed directly in cool compartment 16 on top of cool pack 74. Of course, the present invention also contemplates that items other than food items may be carried in compartments 14, 16. The insulated nature of horizontal interior wall 42 allows warm compartment 14 to be immediately adjacent cool compartment 16.

Warm compartment 14 is configured to be tapered through the cooperation of top wall 30, rear wall 28, and side walls 20, 22. As explained above, top wall 30 is humped such that its middle portion is substantially higher than the portion that joins rear wall 28 and interior vertical wall 40. Upper wall 30 is also configured to be wider at its rear portion where it joins rear wall 28 than the forward portion where it joins vertical interior wall 40. Further, bottom wall 26 may also be wider at its rear portion than its front portion. As such, at least warm compartment 14 is tapered and cool compartment 16 may also be tapered.

Warm compartment 14 is tapered in order to engage articles placed therein such as the soup bowl 76 that is depicted in dashed lines in FIG. 2. Warm compartment 14 retains bowl 76 in an upright position by engaging its upper edges 78 at the forward and rear portions of bowl 76. Side walls 20, 22 also engage bowl 76 to help retain it laterally. Such engagement prevents bowl 76 from substantially moving while container 10 is transported. By preventing such movement inside container 10, the contents of bowl 76 are less likely to spill inside of compartment 14. Of course, tapered compartment 14 will only engage and retain an article such as a bowl 76 if the article is sized to substantially match at least the narrowest portion of compartment 14.

The tapered nature of container 10 also functions to substantially retain a large bowl 80 depicted in dashed lines in FIG. 3. When large bowl 80 is held in container 10, horizontal interior wall 42 is removed such that container 10 is configured to have only two compartments. Container 10 functions to snugly retain bowl 80 in an upright position by engaging its forward and rear edges 82 as depicted in FIG. 3, as well as the sidewalls of bowl 80. When bowl 80 is configured such that its forward edge 82 does not contact upper wall 30, vertical interior wall 40 is used to help snugly retain bowl 80 between rear wall 28 and interior wall 40. However, as was explained above, bowl 80 must at least be the same size as the narrowest portion of the single tapered compartment for the compartment to engage bowl 80.

Figure 4:
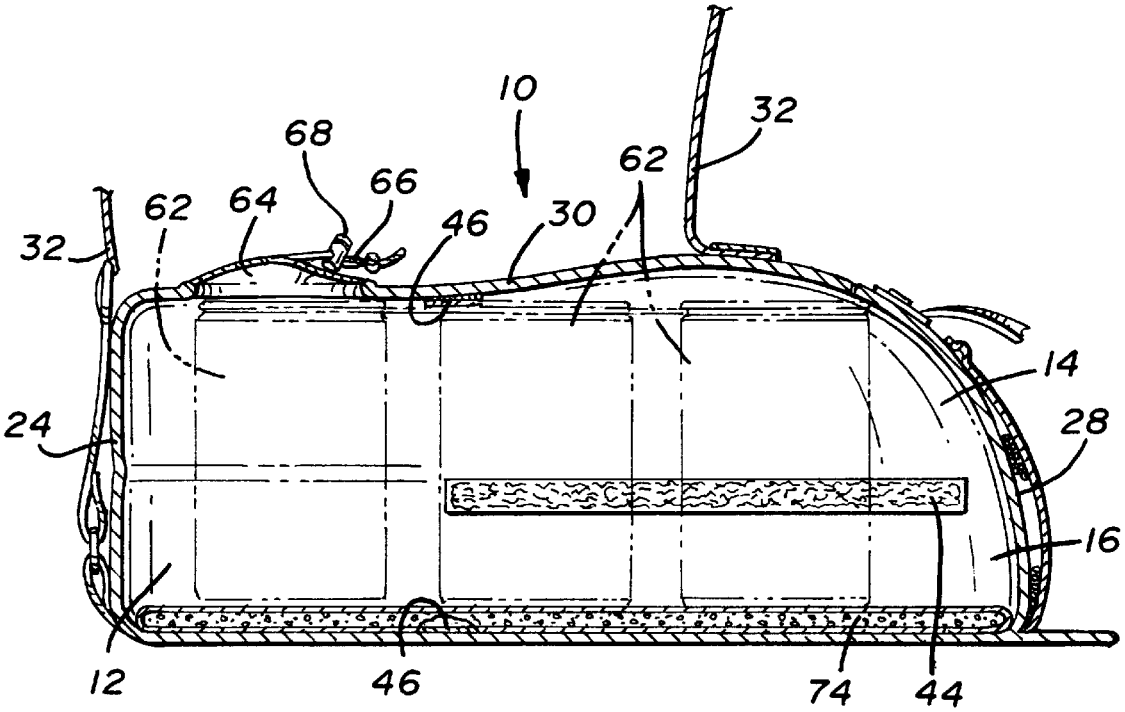
FIG. 4 is a view similar to FIG. 2 showing the container configured to have a single compartment.

Container 10 may also be configured to have a single compartment as depicted in FIG. 4. This is accomplished by removing both interior walls 40, 42. In such a condition, container 10 may be used to carry larger items or a plurality of smaller items such as a six pack of beverage containers 62.

It should thus be evident that a compartmentalized soft-sided container made in accordance with the present invention provides a container having adjustable beverage compartments capable of securely holding differently-sized beverage containers. The container is also selectively configurable to provide one, two, or three compartments for carrying differently-sized objects. The described container also provides a tapered compartment capable of securing retaining an item such as a soup bowl. The compartmentalized, soft-sided container described herein thus accomplishes the objects of the present invention and otherwise substantially improves the art.

I claim:

1. A soft-sided container comprising a plurality of walls defining at least one compartment in the container, said compartment being configured to receive a beverage container, a closure adjustably closing said beverage container compartment such that differently-sized beverage containers may be retained in said beverage container compartment by said closure, and at least one additional wall removably attached to the inside of the container to define a second compartment.

2. A container according to claim 1 wherein said closure includes a flexible sheet of material having an opening therein and a drawstring substantially surrounding said opening such that said opening may be selectively opened and closed by manipulating said drawstring.

3. A container according to claim 2 wherein said closure adjusts to allow beverage containers of different heights to be retained in said beverage container compartment.

4. A container according to claim 1 further comprising at least one more additional wall removably attached to the inside of the container to define a third compartment, said one additional wall being a vertical interior wall and said one more additional wall being a horizontal interior wall.

5. A container according to claim 1 wherein one of said compartments is tapered such that said walls engage an article disposed therein to substantially retain such article.

6. A container according to claim 5 wherein one of said plurality of walls is a top wall being substantially disposed over said tapered compartment, said top wall being humped outwardly from said tapered compartment.

7. A container according to claim 1 wherein one of said plurality of walls is a rear wall removably attached to at least one of said other walls such that said rear wall may be detached from said at least one other wall to provide access to said at least one compartment.

8. A soft-sided container comprising a pair of side walls connected by a top wall, a bottom wall, a front wall, and a rear wall to define a tapered compartment; said top wall having an opening and a drawstring disposed about said opening to adjustably close said opening; said tapered compartment configured to engage an article substantially the same size as the narrowest portion of said tapered compartment when said article is placed in said tapered compartment to substantially retain said article.

9. A container according to claim 8 further comprising a vertical interior wall substantially extending between said bottom wall and said top wall to define a beverage compartment, said beverage compartment substantially disposed below the opening in said top wall.

10. A container according to claim 8 further comprising a vertical interior wall substantially extending between said top wall and said bottom wall and a horizontal interior wall substantially extending between said vertical interior wall and said rear wall.

11. A soft-sided container comprising a pair of side walls connected by a top wall, a bottom wall, a front wall, and a rear wall to define a tapered compartment; said tapered compartment configured to engage an article substantially the same size as the narrowest portion of said tapered compartment when said article is placed in said tapered compartment to substantially retain said article; a vertical interior wall substantially extending between said top wall and said bottom wall and a horizontal interior wall substantially extending between said vertical interior wall and said rear wall; said top wall being humped between said vertical interior wall and said rear wall.

12. A soft-sided container comprising a pair of side walls connected by a top wall, a bottom wall, a front wall, and a rear wall to define a tapered compartment; said tapered compartment configured to engage an article substantially the same size as the narrowest portion of said tapered compartment when said article is placed in said tapered compartment to substantially retain said article; said rear wall being removably attached to said side walls such that said rear wall may be detached from said side walls to provide access to said tapered compartment.

13. A soft-sided container comprising a plurality of exterior walls connected to define a single compartment therein, wherein at least one of said exterior walls is removably attached to at least two of said other exterior walls to provide selective access to the interior of the container, a vertical insulated interior wall removably attached to at least two of said exterior walls such that the container is divided into two compartments when said vertical insulated interior wall is attached to said exterior walls, and a substantially horizontal insulated interior wall removably attached to at least two of said exterior walls such that when said horizontal insulated interior wall is attached to said exterior walls and said vertical insulated interior wall is attached to said exterior walls, three individually insulated compartments are defined by said walls, said insulated interior walls being selectively removable to configure the container to have different numbers of compartments.

14. A container according to claim 13 wherein one of said exterior walls includes an opening, and further comprising an adjustable closure connected to said one of said exterior walls and adjustably closing said opening in said one of said exterior walls.

15. A soft-sided container comprising a plurality of exterior walls connected to define a single compartment therein, one of said walls having an opening and a drawstring disposed about said opening, said drawstring being capable of cinching said opening closed, a vertical insulated interior wall removably attached to at least two of said exterior walls such that the container is divided into two compartments when said vertical insulated interior wall is attached to said exterior walls, and a substantially horizontal insulated interior wall removably attached to at least two of said exterior walls such that when said horizontal insulated interior wall is attached to said exterior walls and said vertical insulated interior wall is attached to said exterior walls, three individually insulated compartments are defined by said walls, said insulated interior walls being selectively removable to configure the container to have different numbers of compartments.

16. A container according to claim 13 wherein said exterior walls are tapered to define at least one tapered compartment inside the container.

17. A soft-sided container comprising a plurality of exterior walls defining a single compartment in the container, a vertical insulated interior wall removably attached to at least two of said exterior walls such that said single compartment is divided into two compartments when said vertical insulated interior wall is attached to said exterior walls, one of said two compartments being configured to received a beverage container, a substantially horizontal insulated interior wall removably attached to at least two of said exterior walls such that when said horizontal insulated interior wall is attached to said exterior walls and said vertical insulated interior wall is attached to said exterior walls, three individually insulated compartments are defined by said walls, said insulated interior walls being selectively removable to configure the container to have different numbers of compartments, at least one of said compartments being tapered to engage an article substantially the same size as the narrowest portion of said tapered compartment when said article is placed in said tapered compartment to substantially retain said article, and a closure carried by one of said exterior walls to adjustably close said beverage container compartment such that differently-sized beverage containers may be retained in said beverage container compartment by said closure.

* * * * *